US008474685B2

(12) United States Patent
Shaboo

(10) Patent No.: US 8,474,685 B2
(45) Date of Patent: Jul. 2, 2013

(54) HEXAGONAL PACKAGE, AND EFFICIENT CONFIGURATION OF SEVERAL HEXAGONAL PACKAGES

(75) Inventor: Joseph Shaboo, Danbury, CT (US)

(73) Assignee: Perpetual Packaging LLC, Danbury, CT (US)

( * ) Notice: Subject to any disclaimer, the term of this patent is extended or adjusted under 35 U.S.C. 154(b) by 44 days.

(21) Appl. No.: 12/352,993

(22) Filed: Jan. 13, 2009

(65) Prior Publication Data

US 2010/0176187 A1 Jul. 15, 2010

(51) Int. Cl.
*B65D 5/42* (2006.01)
*B65D 5/468* (2006.01)

(52) U.S. Cl.
USPC ..... 229/110; 229/117.13

(58) Field of Classification Search
USPC ..... 229/106, 110; 206/822
See application file for complete search history.

(56) References Cited

U.S. PATENT DOCUMENTS

| | | | | |
|---|---|---|---|---|
| 646,920 | A | 4/1900 | Schmidt | |
| 1,585,505 | A | 5/1926 | McIndoe | |
| 1,689,069 | A | 10/1928 | Carver et al. | |
| 1,909,649 | A | 5/1933 | Bayless | |
| 1,998,147 | A | 4/1935 | Stegman | |
| 2,000,210 | A | 5/1935 | Bayless | |
| 2,019,787 | A | 11/1935 | Leopold | |
| 2,044,103 | A | 6/1936 | Rossi | |
| 2,123,147 | A * | 7/1938 | Snyder | 229/110 |
| 2,285,174 | A * | 6/1942 | Simons | 229/110 |
| 2,465,661 | A | 3/1949 | Ringler | |
| 2,468,123 | A | 4/1949 | Shina | |
| 2,517,552 | A | 8/1950 | Field | |
| 2,659,525 | A | 11/1953 | Wikstrom | |
| 2,670,127 | A | 2/1954 | Gleason et al. | |
| 2,826,350 | A | 3/1958 | Marx | |
| 2,828,904 | A | 4/1958 | Mires et al. | |
| 2,858,968 | A | 11/1958 | Pellaton | |
| 2,922,562 | A | 1/1960 | Pellaton | |
| 3,101,167 | A | 8/1963 | Styler | |
| 3,174,675 | A | 3/1965 | Rosenburg, Jr. | |
| 3,232,480 | A | 2/1966 | Stanley | |
| 3,412,924 | A | 11/1968 | Krzyzanowski | |
| 3,462,062 | A | 8/1969 | Miller | |
| 3,467,298 | A | 9/1969 | Wysocki | |

(Continued)

OTHER PUBLICATIONS

<http://www.ferret.com.au/n/The-best-of-paperboard-packaging-n714493>.

(Continued)

*Primary Examiner* — Nathan J Newhouse
*Assistant Examiner* — Christopher Demeree
(74) *Attorney, Agent, or Firm* — Dickstein Shapiro LLP

(57) ABSTRACT

A hexagonal box is formed from a box blank having a rectangular main body divided into six sections which are separated by score lines so that the main body can be folded to create the hexagonal box. The main body has a set of six flaps extending from one end of the six sections, and a second set of six independent flaps extending from the other end of the six sections. Preferably, at least two-thirds of the end-flaps are non-rectangular. Once the box blank is folded into a hexagonal box, the end-flaps may folded inward to create closed ends with minimal end-flap overlap. The hexagonal boxes may be constructed to have handles. A plurality of boxes may be grouped together into a honeycomb formation to maximize the packing density for shipment or transport.

28 Claims, 5 Drawing Sheets

U.S. PATENT DOCUMENTS

| | | | | | |
|---|---|---|---|---|---|
| 3,581,974 | A | * | 6/1971 | Freeman | 229/110 |
| 3,700,161 | A | | 10/1972 | Bundy | |
| 3,738,564 | A | * | 6/1973 | Persson | 229/110 |
| 3,768,720 | A | | 10/1973 | Bundy | |
| 4,063,679 | A | | 12/1977 | Henry | |
| 4,392,607 | A | * | 7/1983 | Perkins, Jr. | 229/109 |
| 4,948,035 | A | | 8/1990 | Wischoff | |
| 5,263,582 | A | * | 11/1993 | Schaaf | 206/326 |
| 5,484,100 | A | | 1/1996 | Rigby | |
| 5,609,269 | A | | 3/1997 | Behnke et al. | |
| 5,816,406 | A | | 10/1998 | Jupille et al. | |
| D495,598 | S | | 9/2004 | Smith | |
| 2003/0116612 | A1 | * | 6/2003 | Polloni et al. | 229/109 |
| 2005/0199696 | A1 | | 9/2005 | MacConkey et al. | |

OTHER PUBLICATIONS

<http://www.foodprocessing.com/articles/2005/491.html?page=2>.

http://www.flickr.com/photos/30673837@N02/5150030697/in/photostream/, viewed Nov. 9, 2011.

* cited by examiner

HEXAGONAL PACKAGE, AND EFFICIENT CONFIGURATION OF SEVERAL HEXAGONAL PACKAGES

FIELD OF THE INVENTION

The present invention relates generally to the field of packaging and more particularly, an improved hexagonal package, and package pallet configuration.

BACKGROUND OF THE INVENTION

Hexagonal containers are an efficient solution to maximize the usable volume within a container, and ultimately the amount of boxed merchandise that can be delivered per shipment. Additionally, hexagonal containers offer the advantage of minimizing the quantity of packaging material (e.g., cardboard) needed to package a given amount of merchandise. While the packaging industry makes use of these advantages, the hexagonal boxes currently available may be improved upon to further minimize the quantity of packaging material and glue necessary to package a given amount of merchandise.

BRIEF SUMMARY OF THE INVENTION

This invention relates to the field of packaging, and more specifically, to an improved hexagonal box and pallet configuration for transporting a plurality of such hexagonal boxes. Hexagonal boxes are very efficient containers in terms of packing density. The improved hexagonal box of this invention minimizes the amount of packaging material and glue necessary for constructing hexagonal boxes, making the use of hexagonal boxes an even more efficient packaging solution.

Additionally, the hexagonal box pallet configuration of the present invention maximizes the volume of items that can be transported in a single shipment.

The box pallet of the present invention arranges a plurality of hexagonal boxes into a honeycomb configuration. Around the periphery of this honeycomb structure there are trapezoidal and triangular spaces. The present invention further includes trapezoidal boxes within the trapezoidal spaces. This combination enhances the packing density of a pallet of hexagonal boxes by filling in what would otherwise be dead space.

DETAILED DESCRIPTION OF THE INVENTION

The present invention comprises an improved hexagonal box and a pallet configuration for transporting multiple hexagonal boxes. The hexagonal boxes are generally made from a cardboard material but other material of construction can also be used if desired. The improved hexagonal box of the present invention, through its novel configurations, minimizes the amount of cardboard and glue used for constructing a hexagonal box. The pallet configuration of the present invention combines the use of a honeycomb configuration of hexagonal boxes with trapezoidal boxes to maximize the packing density of boxes which can be transported at one time.

It should be appreciated that the particular implementations shown and described herein are illustrative of the invention and are not intended to otherwise limit the scope of the present invention in any way. It should be noted that many alternative or additional elements may be present.

The present invention is described below with reference to figures illustrating various aspects of the invention.

Figure 1:
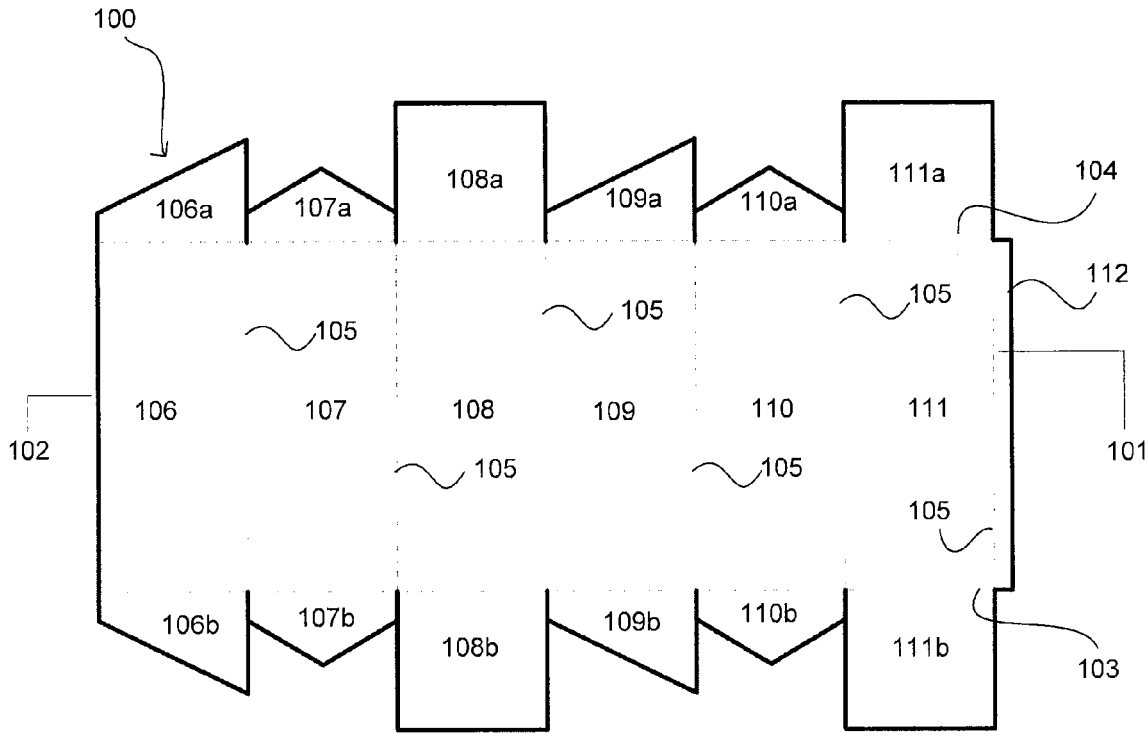
FIG. 1 is a diagram of one embodiment of a box-blank of the present invention.

FIG. 1 shows a box blank, prior to being assembled into a hexagonal box. The box-blank 100 is composed of a central rectangular body having two substantially parallel short sides 101 and 102, and two substantially parallel long sides, 103 and 104. The box-blank 100 is divided by a plurality of score lines 105 which are substantially parallel to the short sides 101 and 102, into six sections 106 through 111 of substantially equal width and height. Ultimately, each of these six sections will constitute a side of the assembled hexagonal box, when the box-blank 100 is folded at the score lines 105. In this preferred embodiment, a part of the central rectangular body extends beyond short side 101 to thereby provide a glue flap 112 for securing section 106 to section 111 after the box blank has been folded at the score lines 105 to create a hexagonal box. While shown as rectangular in FIG. 1, glue flap 112 can have other shapes.

End-flaps 106*a*-111*a*, and 106*b*-111*b* extend from the respective portions of each the respective long edge 103, 104 of each of the six sections 106-111. The end-flaps opposing each other in each section 106-111, preferably, but not necessarily, have the same shape. In this embodiment, adjacent end-flaps 106*a*-111*a*, 106*b*-111*b* have different shapes. Also in this embodiment, most of the end flaps 106*a*-111*a*, 106*b*-111*b* are non-rectangular; and they may be many different shapes in order to minimize the overlap of the end-flaps 106*a*-111*a*, 106*b*-111*b* when the box is assembled. This is consistent with one of the advantages of the present invention, that the cardboard or other box material for constructing a hexagonal box is minimized. Preferably two of the end-flaps 106*a*-111*a*, 106*b*-111*b* extending from each of the long edges 103, 104 are rectangular, and preferably the two rectangular end-flaps are not adjacent to one another.

In the preferred embodiment illustrated in FIG. 1, two of the end-flaps 106*a*-111*a*, 106*b*-111*b* on each long edge 103, 104 are trapezium flaps and two are the pentagonal flaps. It is preferable that all adjacent end-flaps are different from one another to minimize end-flap overlap when folded, and therefore minimize material of construction usage.

In FIG. 1 two of the end flaps 106*a*-111*a*, 106*b*-111*b* extending from each long edge 103,104 are pentagonal, and two of the end flaps 106*a*-111*a*, 106*b*-111*b* extending from each long edge 103,104 are trapeziums. But the end-flaps are not limited to the aforementioned shapes. By way of example, and without limitation, end-flaps may be semi-circular, triangular, trapezoidal, or a hybrid shape. The combination of shapes is chosen to minimize the amount of end-flap overlap when the box is formed. Furthermore, the non-rectangular flaps preferably have less area than the rectangular flaps.

The end-flaps are integral with the central body but are foldable as a consequence of long edges 103 and 104 being scored. The intersecting sides of adjacent end-flaps are separate from one another, for example by being cut, so that each flap is independently foldable. In the preferred embodiment, each of two pairs of the sides of the pentagonal shaped end-flaps have the same length, and all of the sides of the trapezoidal shaped end-flaps have different lengths.

Figure 2:
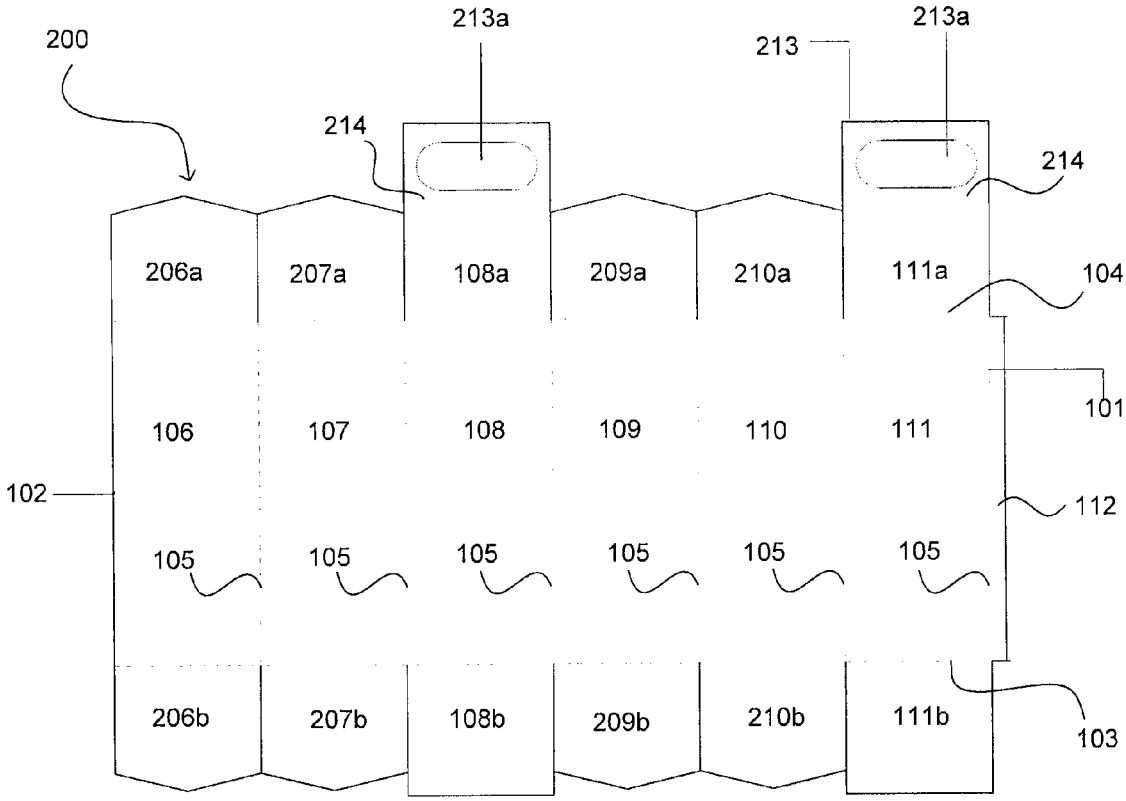
FIG. 2 is a diagram of a second embodiment of a box-blank of the present invention.

The embodiment illustrated in FIG. 2 differs from that in FIG. 1 in two respects. First, apertures 213*a* are provided in two of the rectangular end-flaps, 108*a* and 111*a*, and a score line 214 is provided so that a portion of each end-flap 108*a* and 111*a* can be folded at an angle away from the rest of end-flaps 108*a* and 111*a* to form handle portions 213. While the handle portions 213 in this embodiment are part of the rectangular flaps, the handle portions 213 may be a part of any type of end-flap. Furthermore, while this embodiment illustrates two handle portions 213, there can be embodiments that have only one handle portion 213, or embodiments with more than two handle portions 213. Also, while the handle portions 213 of the embodiment illustrated in FIG. 2 are rectangular shaped, with an elliptical through-hole 213*a*, the handles 213 and apertures 213*a* may take other shapes. The second difference is that four of the end-flaps 206*a*, 207*a*, 209*a*, 210*a*, 206*b*, 207*b*, 209*b* and 210*b* on each of sides 103 and 104 have the same shape.

Figure 3:
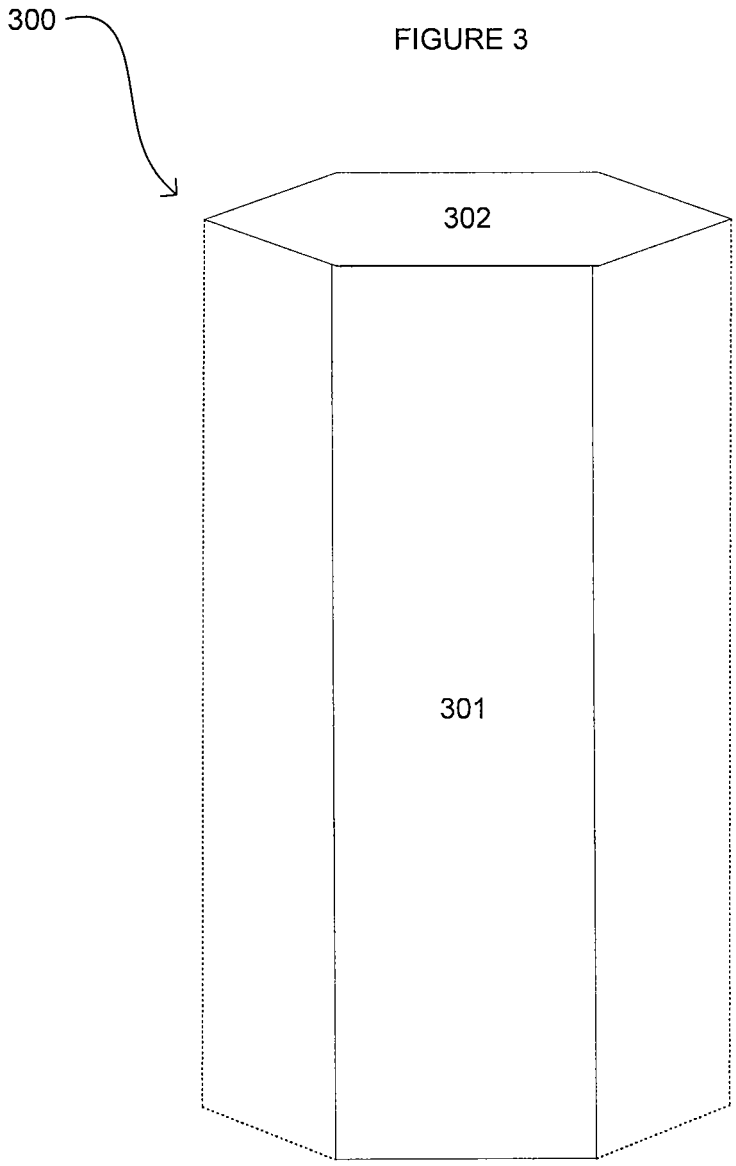
FIG. 3 is a trimetric projection diagram of one embodiment of the hexagonal box of the present invention.

FIG. 3 shows a hexagonal box 300 constructed from box blank 100 of FIG. 1. The box is in the shape of a normal hexagon. It has six sides 301, each having substantially equal width and height corresponding to sections 106-111. The independently-foldable end-flaps 106*a*-111*a* have been folded inward, preferably at right angles to each respective side 301 to form a closed top portion. FIG. 3 provides a simplified depiction of the closed top 302. The opposite end of the box, (i.e., the bottom end) is similarly formed.

Figure 4:
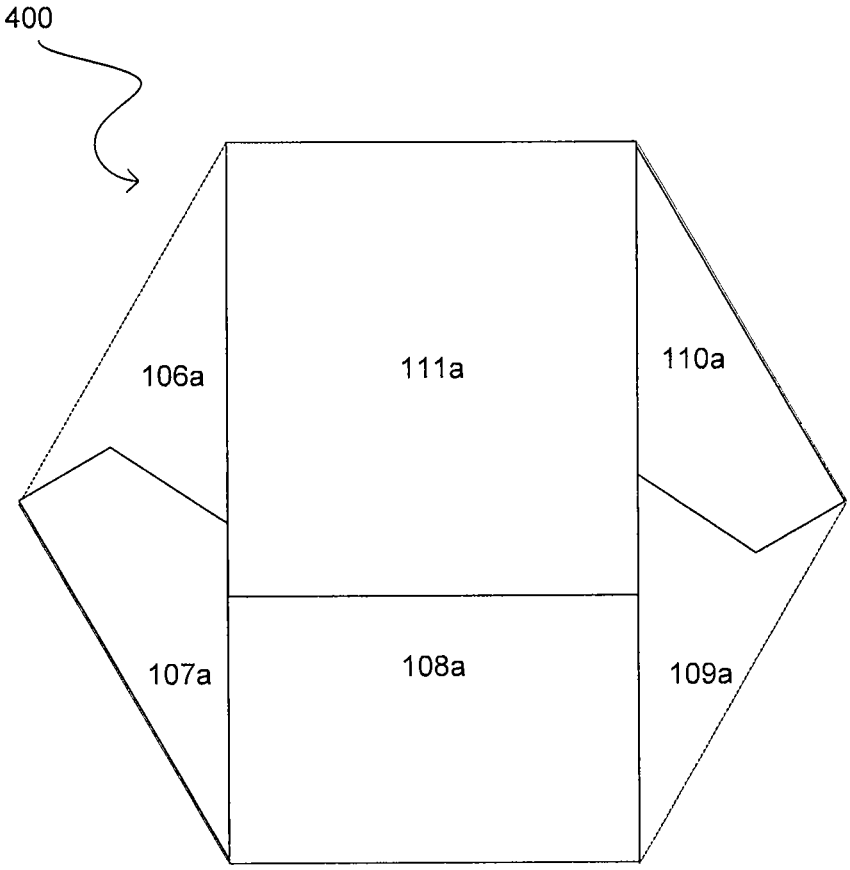
FIG. 4 is a top view of the hexagonal box of FIG. 3.

FIG. 4 is a top view of one possible configuration of box 300, the bottom view, in this instance, being a mirror image thereof. As can be seen, the end is securely closed with minimum overlap of the end-flaps 106*a*-111*a*. The other end of the box is closed in the same way, although the order of the end-flaps may be varied.

Although the closed top and bottom are composed of primarily non-rectangular end-flaps, they are securely closed. The use of mostly non-rectangular end-flaps allows for minimizing the amount of packaging material needed to create the hexagonal box 300 while maintaining the structural integrity of the whole box 300, including the closed ends.

Figure 5:
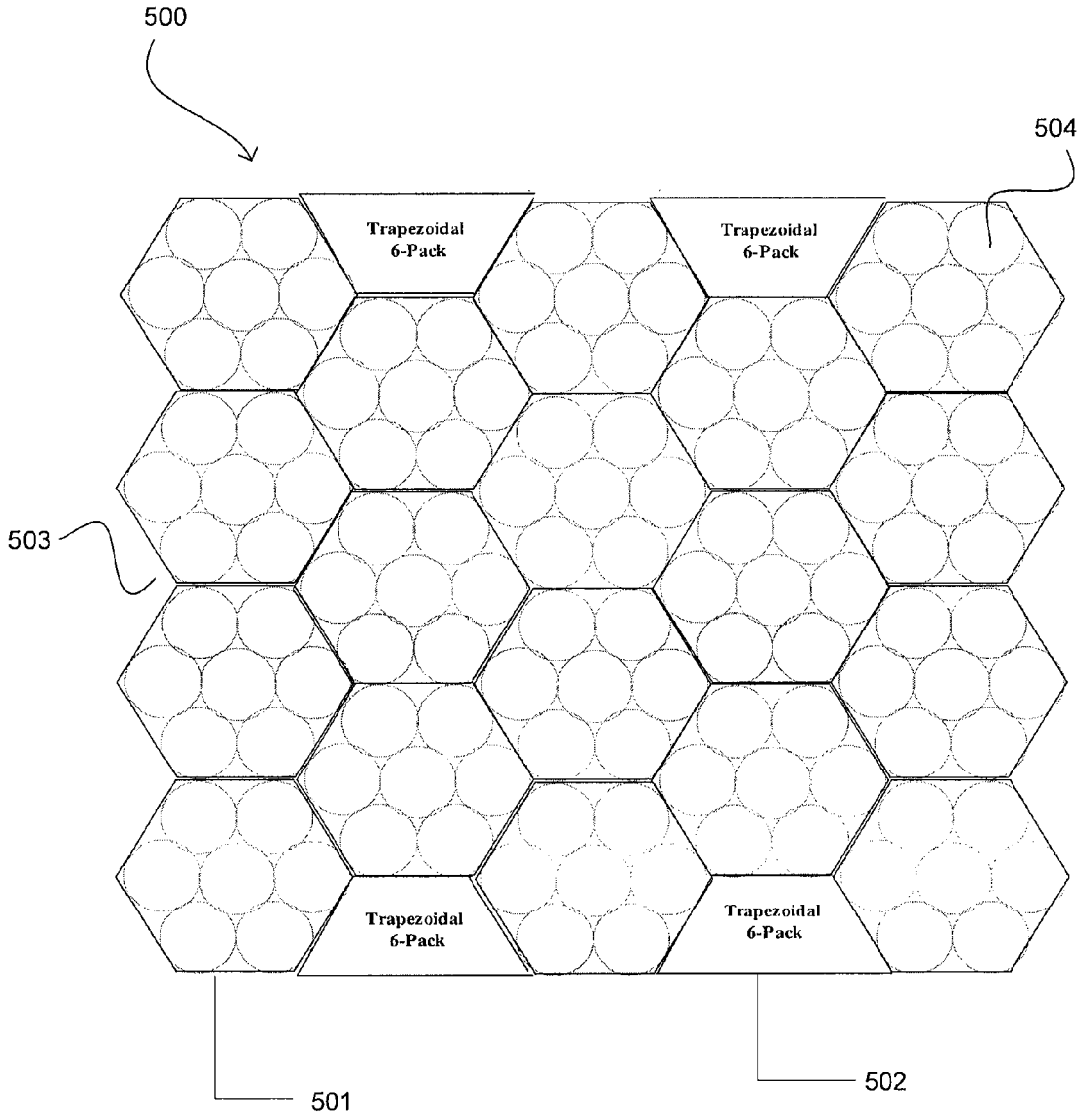
FIG. 5 is a top view of one embodiment of a hexagonal box pallet configuration of the present invention.

Referring to FIG. 5, it can be seen that a pallet 500 has been formed using a plurality of hexagonal boxes 501 stacked together in a honeycomb formation. FIG. 5 also depicts a preferred embodiment, where the hexagonal boxes, contain a plurality of food or beverage cans 504. This honeycomb formation maximizes packing density of the hexagonal boxes 501. At portion of pallet 500, the honeycomb configuration results in empty trapezoidal spaces. Such spaces may be filled with trapezoidal boxes 502, further maximizing the packing density of the boxes on the pallet. Although the embodiment illustrated in FIG. 5 leaves some spaces 503 along the periphery of the honeycomb formation unfilled, those spaces may be filled with boxes of different shapes, such as triangular or rectangular, or hexagonal boxes having a smaller cross-section, to further maximize the packing density of the presently-described hexagonal-box pallet embodiment 500.

What is claimed is:

1. A box blank for forming a hexagonal box comprising:

a rectangular main body, having opposed first and second sides, and opposed third and fourth sides adapted to form a hexagonal box wherein all internal angles are obtuse; and flaps consisting of a first set of six independent flaps extending from the third side, and a second set of six independent flaps extending from the fourth side;

wherein at least two adjacent flaps on the third side have different shapes, wherein at least two adjacent flaps on the fourth side have different shapes, wherein each independent flap has no less than four and no more than five sides; and wherein no more than two of the six flaps of the first set and no more than two of six the flaps of the second set are rectangular.

2. The box blank of claim 1, wherein at least two of the flaps of the first set, and at least two of the flaps of the second set are pentagonal.

3. The box blank of claim 1, wherein at least two of the flaps of the first set, and at least two of the flaps of the second set are trapeziums, and wherein the flaps abut without creating a space along the third and fourth sides.

4. The box blank of claim 1, wherein two of the flaps of the first set, and two of the flaps of the second set are rectangular.

5. The box blank of claim 4, wherein at least two of the flaps of the first set and at least two of the flaps of the second set are pentagonal, and at least two of the flaps of the first set and at least two of the flaps of the second set are trapeziums.

6. The box blank of claim 5, wherein at least one flap includes an aperture.

7. The box blank of claim 5, wherein the opposing flaps of the first and second sets have the same shape.

8. The box blank of claim 7 further comprising a glue flap extending from the first side.

9. The box blank of claim 1 further comprising a glue flap extending from the first side.

10. The box blank of claim 1, wherein at least one flap includes a hole which is adapted to be used as a handle.

11. The box blank of claim 1, wherein the opposing flaps of the first and second sets have the same shape.

12. The box blank of claim 1, wherein the rectangular main body is adapted to form a regular hexagonal box.

13. The box blank of claim 1, wherein the opposing flaps of said first and second sets do not have the same shape.

14. The box blank of claim 1, wherein three adjacent flaps on the first set repeat a pattern with three other adjacent flaps on the first set, and wherein three adjacent flaps on the second set repeat a pattern with three other adjacent flaps on the second set.

15. The box blank of claim 1, wherein going from the first side to the second side there are two subsets of adjacent flaps and each subset consists of a rectangle, a pentagon, and a trapezium.

16. A hexagonal package comprising:

a main hexagonal body consisting of six connected panels wherein all internal angles between adjacent panels are obtuse, each panel having opposed first and second edges not connected to another panel, each panel having a first and second foldable flap extending from the first and second edges, respectively, wherein each foldable flap has no less than four and no more than five sides, wherein at least two adjacent flaps on adjacent first edges have different shapes, at least two adjacent flaps on adjacent second edges have different shapes, and no more than two of the flaps extending from the first edges of the six panels are rectangular; and no more than two of the flaps extending from the second edges of the six panels are rectangular.

17. The hexagonal package of claim 16, wherein flaps extending from said first edges are folded inward toward the center of the main body and overlap so as to close the area defined by said first edges.

18. The hexagonal package of claim 17, wherein at least one flap has an area in which a hole which is adapted to be used as a handle is disposed.

19. The hexagonal package of claim 18, wherein flaps extending from said second edges are folded inward toward the center of the main body and overlap so as to close the area defined by said second edges.

20. The hexagonal package of claim 16, wherein flaps extending from said second edges are folded inward toward the center of the main body and overlap so as to close the area defined by said second edges, and the package is a regular hexagonal package.

21. The hexagonal package of claim 16, wherein at least two of the flaps extending from the first edges, and at least two of the flaps extending from the second edges are pentagonal.

22. The hexagonal package of claim 16, wherein at least two of the flaps extending from the first edges, and at least two of the flaps extending from the second edges are trapeziums, and wherein adjacent flaps on adjacent panels are disposed to overlap when folded perpendicular to the panels without creating a space between them at the respective first and second edges.

23. A pallet comprising:

a support surface having a plurality of hexagonal boxes of claim 16 disposed thereon in a honeycomb configuration.

24. The hexagonal package of claim 16, wherein at least one first foldable flap does not have the same shape as the second foldable flap of the same panel.

25. The hexagonal package of claim 16, wherein three adjacent foldable flaps on adjacent first edges repeat a pattern with three other adjacent foldable flaps on adjacent first edges, and wherein three adjacent foldable flaps on adjacent second edges repeat a pattern with three other adjacent foldable flaps on adjacent second edges.

26. The hexagonal package of claim 16, wherein there are two adjacent subsets of three foldable flaps extending from the first edges and two adjacent subsets of three foldable flaps extending from the second edges, and each subset consists of a rectangle, a pentagon, and a trapezium.

27. A box blank for forming a hexagonal box comprising:

a rectangular main body, having opposed first and second sides, and opposed third and fourth sides adapted to form a hexagonal box wherein all internal angles are obtuse; and flaps consisting of a first set of six independent flaps extending from the third side, and a second set of six independent flaps extending from the fourth side;

wherein at least two adjacent flaps on the third side have different shapes, wherein at least two adjacent flaps on the fourth side have different shapes, and wherein each flap has two right angles formed from three consecutive sides of the flap.

28. A box blank for forming a hexagonal box comprising:

a rectangular main body, having opposed first and second sides, and opposed third and fourth sides adapted to form a hexagonal box wherein all internal angles are obtuse; and flaps consisting of a first set of six independent flaps extending from the third side, and a second set of six independent flaps extending from the fourth side;

wherein at least two adjacent flaps on the third side have different shapes, wherein at least two adjacent flaps on the fourth side have different shapes, wherein each independent flap has at least four sides, and wherein each flap has at least one adjacent side that forms an internal angle of no more than ninety degrees with a side of the flap connected to the main body.

* * * * *

UNITED STATES PATENT AND TRADEMARK OFFICE

CERTIFICATE OF CORRECTION

PATENT NO. : 8,474,685 B2
APPLICATION NO. : 12/352993
DATED : July 2, 2013
INVENTOR(S) : Joseph Shaboo It is certified that error appears in the above-identified patent and that said Letters Patent is hereby corrected as shown below:

Title Page, Item (54) and in the Specification at Column 1, Title delete "HEXAGONAL PACKAGE" and replace with "HEXAGON PACKAGE".

Signed and Sealed this
Fifth Day of November, 2013

Teresa Stanek Rea

Teresa Stanek Rea
*Deputy Director of the United States Patent and Trademark Office*